US005649371A

United States Patent [19]

Loser et al.

[11] Patent Number: 5,649,371

[45] Date of Patent: Jul. 22, 1997

[54] DRY UNIT OF A DRY END OF A MACHINE FOR PRODUCING MATERIAL WEBS

[75] Inventors: Hans Loser, Langenau, Germany; Thomas Elenz, Barueri, Brazil; Albrecht Meinecke, Heidenheim, Germany; Helmut Konecsny, Baulkham Hills, Australia

[73] Assignee: Voith Sulzer Papiermaschinen GmbH, Heidenheim, Germany

[21] Appl. No.: 596,793

[22] Filed: Feb. 5, 1996

[30] Foreign Application Priority Data

Feb. 4, 1995 [DE] Germany ..... 195 03 767.7

[51] Int. Cl.[6] ..... F26B 11/02

[52] U.S. Cl. ..... 34/111; 34/117

[58] Field of Search ..... 34/111, 112, 113, 34/114, 117, 118, 120; 162/358.3, 271, 273, 274

[56] References Cited

U.S. PATENT DOCUMENTS

| | | | |
|---|---|---|---|
| 2,433,122 | 12/1947 | Hornstobel | 34/111 |
| 3,151,953 | 10/1964 | Justus | 34/118 |
| 3,354,035 | 11/1967 | Gottwald et al. | 34/118 |
| 3,730,675 | 5/1973 | Previati | 34/123 X |
| 3,797,384 | 3/1974 | Hoff | 162/358.3 X |
| 4,030,320 | 6/1977 | Riedel | 34/115 X |
| 5,031,338 | 7/1991 | Wedel | 34/117 X |

FOREIGN PATENT DOCUMENTS

| | | |
|---|---|---|
| 0355873 | 2/1990 | European Pat. Off. . |
| 2324704 | 11/1974 | Germany . |
| 4416585 | 10/1994 | Germany . |
| 9108339 | 6/1991 | WIPO . |
| 9220860 | 11/1992 | WIPO . |

OTHER PUBLICATIONS

Ernst L. Back, "Why Is press Drying/Impulse Drying Delayed?" Mar. 1991.

*Primary Examiner*—John M. Sollecito
*Assistant Examiner*—Steve Gravini
*Attorney, Agent, or Firm*—Anderson Kill & Olick P.C.

[57] ABSTRACT

A dry unit of a dry end of a machine for producing a material web and including at least one drying cylinder and a plurality of dry felts parsing around the dry cylinder one above another, with at least two of the dry felts being lifted off the dry cylinder at different circumferential positions of the two dry felts on the dry cylinder.

10 Claims, 5 Drawing Sheets

DRY UNIT OF A DRY END OF A MACHINE FOR PRODUCING MATERIAL WEBS

BACKGROUND OF THE INVENTION

The present invention relates to a dry unit of a dry end, in particular, of a paper machine for producing paper webs and including at least one drying cylinder and a dry felt, which is at least partially wrapped around the drying cylinder, with a paper web passing between the dry felt and the drying cylinder.

A dry unit of the above-described type is disclosed in German publication DE 44 16 585. The publication discloses a dry unit for a dry end and including a plurality of heatable drying cylinders and pressure bands (also called dry felts) which press a to-be-dried material web to a drying cylinder.

Generally, single-row and double-row dry units are used. With a single-row dry unit, a material web passes, along a meander-shaped path, alternatively about a drying cylinder and deflection rolls. Thus, when a single-row dry unit is used, only one side of the material web comes into contact with outer surfaces of the drying cylinders, with the other side abutting the pressure band.

With a double-row dry unit, a material web likewise passes along a meander-shaped path, but it is passed, alternatively, from a drying cylinder of one row to a drying cylinder of another row so that one side of the material web comes into contact with the drying cylinder of the one row, and another side of the material web comes into contact with the drying cylinder of the another row.

Usually, each of the two drying cylinders cooperates with a respective pressure band which presses the material web to the outer surface of the drying cylinder.

A dry end of a paper machine often includes a combination of single-row and double-row dry units, whereby the characteristics of a material web, such as shrinkage and strength, can be appropriately influenced.

An increase of the material web strength can be achieved by providing, in an interior of the material web, a temperature of about 100° C. To this end, often gas-fired drying cylinders are used, the temperature of which can reach about 300° C. By additionally using high-stressed, rigid pressure bands, a vapor pressure in the inside of the material web can be attained that would be much higher than the environmental pressure.

However, at that, upon lifting of a pressure band from the material web surface, the vapor pressure established in the material web interior is released abruptly. The sudden release of the vapor pressure results in splinting of the material web in some places or, in worst cases, the sudden release of the vapor pressure leads to rupture of the web.

Accordingly, an object of the invention is to provide a dry unit in which the splinting of the material web and/or web rupture is reliably prevented.

SUMMARY OF THE INVENTION

This and other objects of the present invention, which will become apparent hereinafter, are achieved by providing, according to the present invention, a plurality of pressure bands, further called dry felts, arranged one above another for pressing a material web to the drying cylinder, which pressure bands (dry felts) are lifted off the drying cylinder at different circumferential positions of the dry felts relative to the drying cylinder. Lifting of the dry felts of the drying cylinder at different circumferential position thereof on the drying cylinder permits to provide for a stepwise release of the vapor pressure, whereby the danger of splinting of the material web and/or its rupture is reliably prevented.

Using three or more dry felts, which are lifted off the drying cylinder one after another after certain intervals, permits to stepwise reduce the pressure force acting on the material web which results, in turn, in the stepwise release of the vapor pressure. The stepwise release of the vapor pressure is further improved by using, according to the present invention, separate dry felts, with different permeabilities, i.e., by using dry felts having different vapor perviousness. Thus, the outermost dry felt, when viewed from the cylinder, may have advantageously a zero permeability, with the inside dry felts having an ever increased permeability.

According to a further development of the invention, the outer dry felts wrap smaller circumferential regions of the drying cylinder than the inner dry felts. Advantageously, the wrapping angle of separate dry felts, when viewed from the cylinder, increases from outside inward.

According to a further advantageous embodiment of the present invention, the innermost dry felt is made of a finer and/or thinner material.

Using a fine innermost dry felt, which comes into direct contact with a material web, permits to provide for a very smooth outer surface of the material web. This is because fine dry felts have a reduced felt stress. However, a sufficient pressure force is insured by using more rigid and thicker outer dry felts which, thereby, have an increased felt stress and, thus, apply an increased pressure force.

The present invention is obviously applicable as to single-row dry units so to double-row dry units.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENTS

A drying cylinder 1 and two deflection rolls 3 and 5, which are located adjacent to the drying cylinder 1, form part of a single-row drying unit. Usually, such a single-row drying unit consists of several drying cylinders and associated therewith respective pairs of deflection rolls arranged in a row. The drying cylinders and the deflection rolls are generally so arranged that a paper web passes through the dry unit along a meander-shaped path, with the paper web alternatively passing around drying cylinders and the corresponding deflection rolls.

Figure 1:
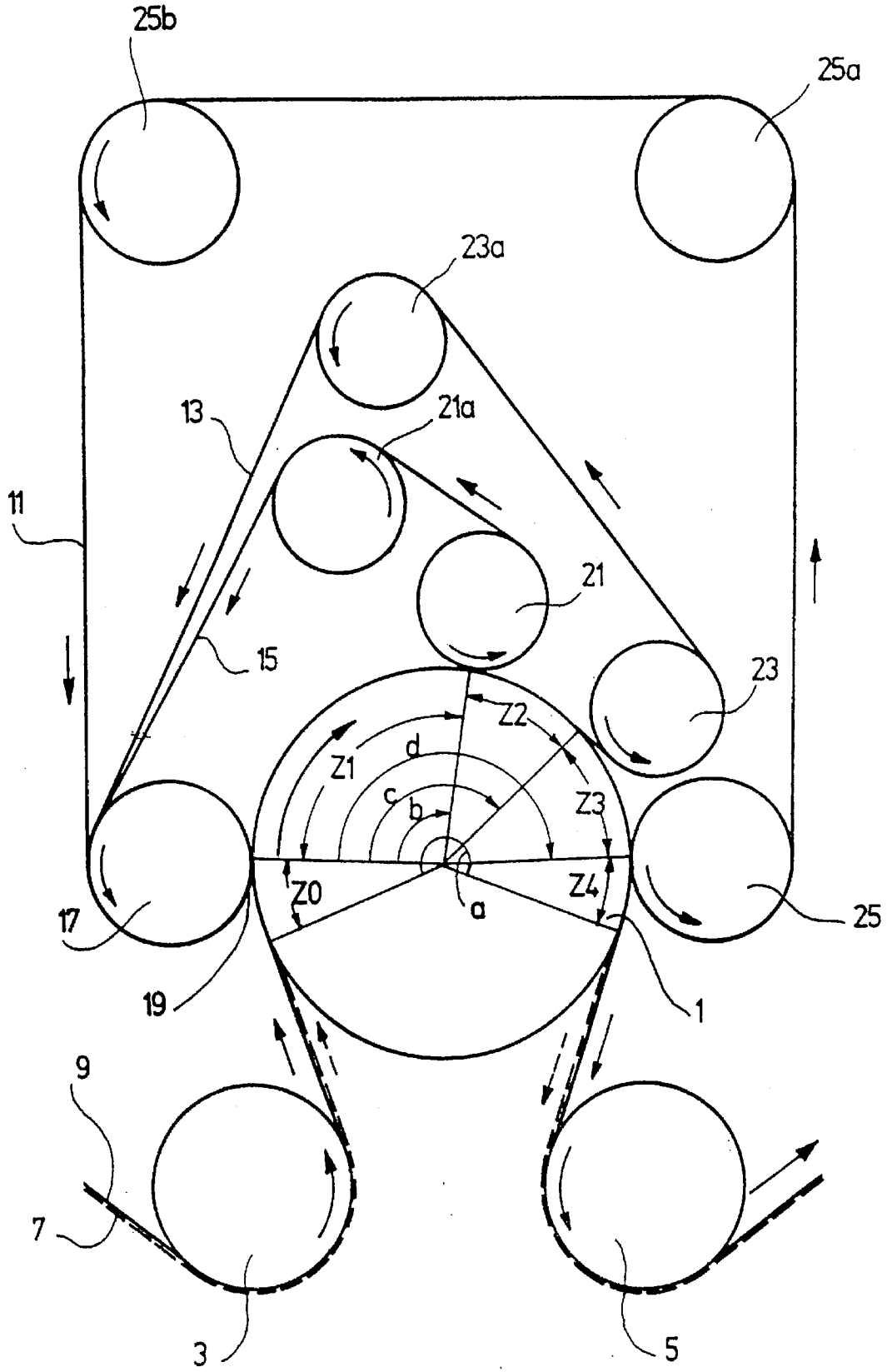
FIG. 1 shows a schematic view of a first embodiment of a single-row drying unit according to the present invention.

In the embodiment shown in FIG. 1, a paper web 7 passes around the deflection roll 3, then around the drying cylinder 1 and, finally, around the next deflection roll 5. A wrapping angle a, which is formed by the paper web 7 around the drying cylinder 1, i.e., the wrapping region, depends on the distance between or the arrangement of deflection rolls 3 and 5. The wrapping angle a defines a wrapping region in which heating of the paper web 7 by the outer surface of the drying cylinder 1 takes place. Usually, to this end, the interior of the drying cylinder is supplied with steam. However, if high temperatures, e.g., of about 300° C., are required, then gas firing of the cylinder, i.e., burning of gases in the cylinder interior is used.

In addition to a first continuous dry felt 9, three additional dry felts 11, 13 and 15 are provided. All of the three additional dry felts 11, 13 and 15 are running together with the first dry felt 9 around a common deflection roll 17 at a common point 19. Thus, at this point, all four dry felts 9, 11, 13 and 15 lie on the paper web 7 one after another. The pressing force applied to the paper web 7 consists of four separate force components generated by the dry felts 9, 11, 13 and 15.

The outermost dry felt 15 wraps the drying cylinder 1 about a wrapping angle b and is deflected from the dry cylinder 1 by a deflection roll 21. The dry felt 15 is then returned to the deflection roll 17 by another deflection roll 21*a*.

In a similar way, the dry felt 13, which wraps the drying cylinder 1 about a wrapping angle c, is guided by deflection rolls 23 and 23*a*, and the dry felt 11, which wraps the drying cylinder 1 about a wrapping angle d, is guided by deflection rolls 25, 25*a* and 25*b*. Only the first dry felt 9 remains in contact with the paper web 7 as it runs about the deflection roll 5.

FIG. 1 clearly shows that the wrapping angle a of the first dry felt is largest while the wrapping angles d, c, b of the following one another dry felts 11, 13 and 15 are stepwise smaller.

With this inventive arrangement of the dry felts, the pressing force acting on the paper web 7 is stepwise reduced, with the biggest force being applied in the wrapping region defined by the wrapping angle b when all four dry felts 9, 11, 13 and 15 lie on the paper web 7, while the pressing force at the end of the wrapping region defined by the wrapping angle a is zero. Thus, four different pressure zones Z1, Z2, Z3 and Z4 are formed in the wrapping region which defines the contact of the paper web 7 with the dry cylinder 1.

When the paper web 7 passes the first pressure region Z1, a very high pressing force is applied thereto, and a very good heat transfer from the drying cylinder 1 to the paper web 7 takes place. As a result, water vapor, which is formed in the interior of the paper web by heating, cannot escape. As a result, a vapor pressure is generated in the paper web interior which is high in comparison with the environmental pressure. In the second pressure zone Z2, the pressing force is somewhat reduced in comparison with the environmental pressure, with the accompanying reduction in the vapor pressure. A further reduction of the pressing force and of the vapor pressure takes place in the pressure zones Z3 and Z4, with the difference between the vapor and environmental pressures in the fourth pressure zone Z4 being relatively small. Thereby, when the paper web 7 is lifted off the dry cylinder 7, due to the reduced vapor pressure, splintering of the paper web does not occur, because the major portion of the vapor pressure has already been diverted in the pressure zones Z2, Z3 and Z4.

An increase in the effect resulting from providing different pressure zones can be achieved by using dry felts 11, 13 and 15 having different permeabilities.

For example, in the first pressure zone Z1 in which the pressing force or vapor pressure is high, the outmost dry felt 15 may have a 0 permeability, i.e., a vapor impermeable dry felt is used. The permeability of the following dry felts 13, 11, and 9 increases from one dry felt to another, so that the vapor permeability increases stepwise from the pressure zone Z2 to the pressure zone Z4. With this, the vapor pressure is stepwise reduced to a magnitude which does not cause splinting of the paper web.

By selecting a very fine first dry felt 9, the formation of felt markings on the upper surface of the paper web, as a result of the contact of the paper web with the dry felt, can be effectively prevented. Fine dry felts have a low felt stress which, however, can be compensated by selecting stronger dry felts 11, 13 and 15.

Figure 2:
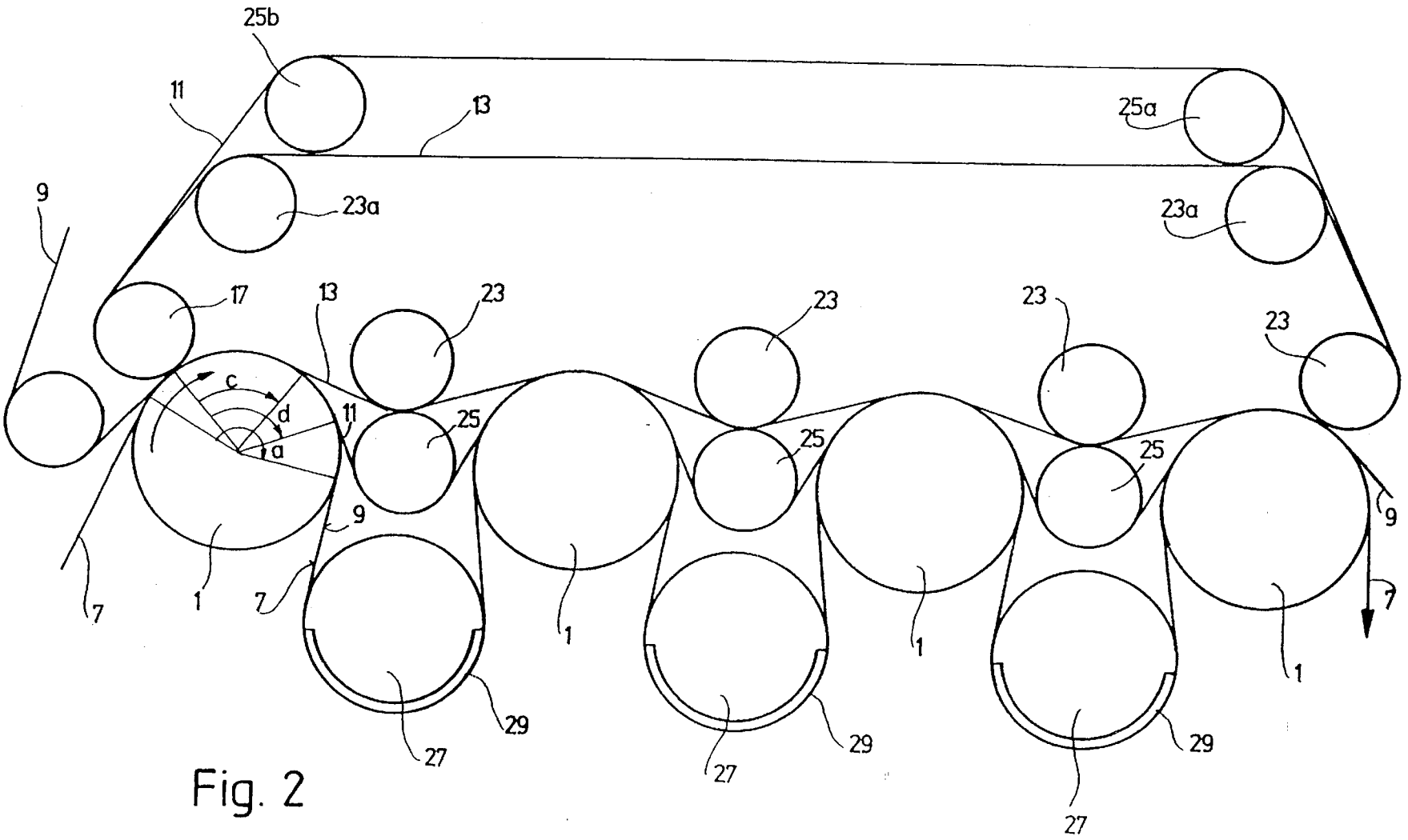
FIG. 2 shows a schematic view of a second embodiment of a single-row drying unit according to the present invention.

FIG. 2 shows another embodiment of a dry unit according to the present invention, which is also a single-row dry unit. In comparison with the dry unit shown in FIG. 1, the dry unit shown in FIG. 2 has several dry cylinders 1 and several dry suction rolls 27 arranged in a row.

In the embodiment of FIG. 2 instead of four dry felts, only three dry felts 9, 11, and 13 are provided. Contrary to the embodiment of FIG. 1, in the embodiment of FIG. 2, the separate dry felts 9, 11 and 13 are returned back not after each dry cylinder 1 but only when they reach the end of the dry unit.

However, generally, the basic design of the embodiment shown in FIG. 2 corresponds to that of the embodiment of FIG. 1. Here also, in addition to a dry felt 9, which is displaceable together with the paper web 7, additional dry felts 11 and 13 are provided. The additional dry felts 11 and 13 are displaced together with the dry felt 9 at the start of the dry run of the paper web 7 about the dry cylinder 1 and are wrapped around the dry cylinder 1 with different angles c and d. Between the dry cylinders 1, there are provided deflection rollers 23 and 25 associated, respectively, with the dry felts 11 and 13. By a respective arrangement of the deflection rolls 23 and 25, the respective wrapping angles c and d can be appropriately adjusted. The deflection rolls 23 and 25 fuide the dry felt 11 and 13 about the dry cylinders 1 arranged one after another, as shown in FIG. 1. At the end of the dry unit, the two additional dry felts 11 and 13 are guided about a common deflection roll 23 from the east in the row cylinder 1 to the beginning of the dry unit.

Functionally, the embodiment of a dry unit shown in FIG. 2 correspond to that of FIG. 1, so that describing of its operation is believed to be unnecessary.

However, in the embodiment of FIG. 2, instead of simple deflection rolls 3 and 5, so-called dry suction rolls 27 are used. The dry suction rolls 27 have in their circumferential region a suction zone 29 along which the paper web 7, together with the dry felt 9, are driven. In the suction zones 29, the paper web 7 is drawn to the dry felt 9. Due to elevated friction forces acting between the paper web 7 and the dry felt 9 in the suction zones 29, shrinkage of the paper web is prevented or at least is substantially reduced. In addition, waving of the paper web 7, as it passes around the suction roll 27, is likewise eliminated.

As shown in FIG. 2, the diameter of the dry suction roll 27 substantially correspond to that of the dry cylinder 1. In comparison with the embodiment of FIG. 1, in the embodiment of FIG. 2, the diameter of the dry cylinder 1 is somewhat smaller, and the diameter of the deflection roll, i.e., of the dry suction roll is larger. Such correspondence of the diameters of the dry cylinder and of the deflection roll results in an increase of the wrapping region which leads to a better heat transfer from the dry cylinder to the paper web. On the other side, the dry suction rolls can be made more rigid so that an increase in a longitudinal stress is possible.

Because of a high longitudinal stress of the dry felt and a resulting therefrom pressing force acting on the paper web, the paper web strength can be increased by an additional compression of the material.

Figure 3:
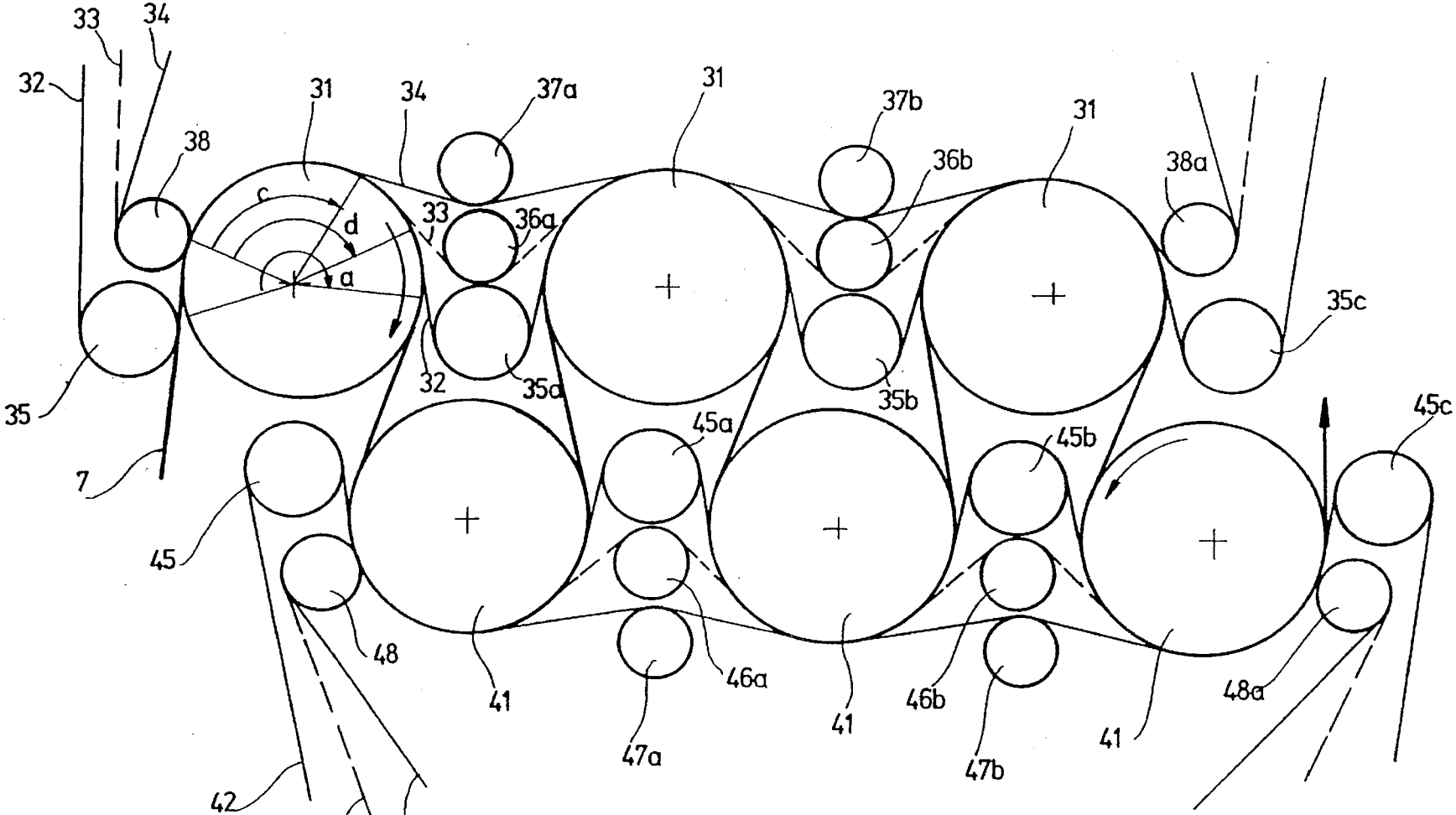
FIG. 3 shows a schematic view of a double-row drying unit according to the present invention.

FIG. 3 shows an application of the inventive concept to a double-row dry unit. As it has been mentioned previously, the double-row dry unit is generally formed of two rows of dry cylinders 31 and 41, respectively. The paper web 7, in this case, passes through the dry unit along a meander-shaped path from a dry cylinder 31 to a lower dry cylinder 41 and so forth.

Each dry cylinder row is associated with dry felts 32, 33, 34 and 42, 43, 44, respectively, which correspond to the dry felts 11, 13, 15 of FIG. 1.

At the beginning of the double-row dry unit, a dry felt 32 is displaced, together with the paper web 7, about the deflection roll 35. The dry felt 32 wraps the dry cylinder 31 about a wrapping angle a and is deflected by a further deflection roll 35*a*. The deflection roll 35*a* serves for joint displacement of the dry felt 32 and the paper web 7 to an adjacent dry cylinder 31 of the upper row of dry cylinders. This process continues until the paper web 7 and the dry felt 32 reach the last dry cylinder 31 of the upper row, where another deflection roll 35*c* returns the dry felt 32 back to the beginning of the dry unit.

The dry felts 33 and 34 are guided by deflection rolls 36*a*, 36*b* and 37*a*, 37*b*, respectively, corresponding to deflection rolls 35*a*, 35*b*. The guiding of the dry felts 33 and 34 at the beginning of the dry unit and their return at the end of the dry unit is effected with deflection rolls 38 and 38*a*, respectively.

By a corresponding arrangement of deflection rolls 35*a*, 36*a*, 37*a* and 35*b*, 36*b*, 37*b* different wrapping angles of the dry felts 32, 33, 34 about the dry cylinder 31 can be provided, as it had already been mentioned previously. The wrapping angle c of the outmost dry felt 34 is smallest and the wrapping angle a of the innermost dry felt 32 is largest. The effect of the different wrapping angles has already been described previously, with reference to FIG. 1. Therefore, any further description would be superfluous.

The double-row dry unit shown in FIG. 3 is symmetrically formed, and the dry felts 42, 43, 44 are guided by deflection rolls 45–48 in the same manner as the dry felts 32, 33, 34 of the upper row are guided by the deflection rolls 35–38.

Figure 4:
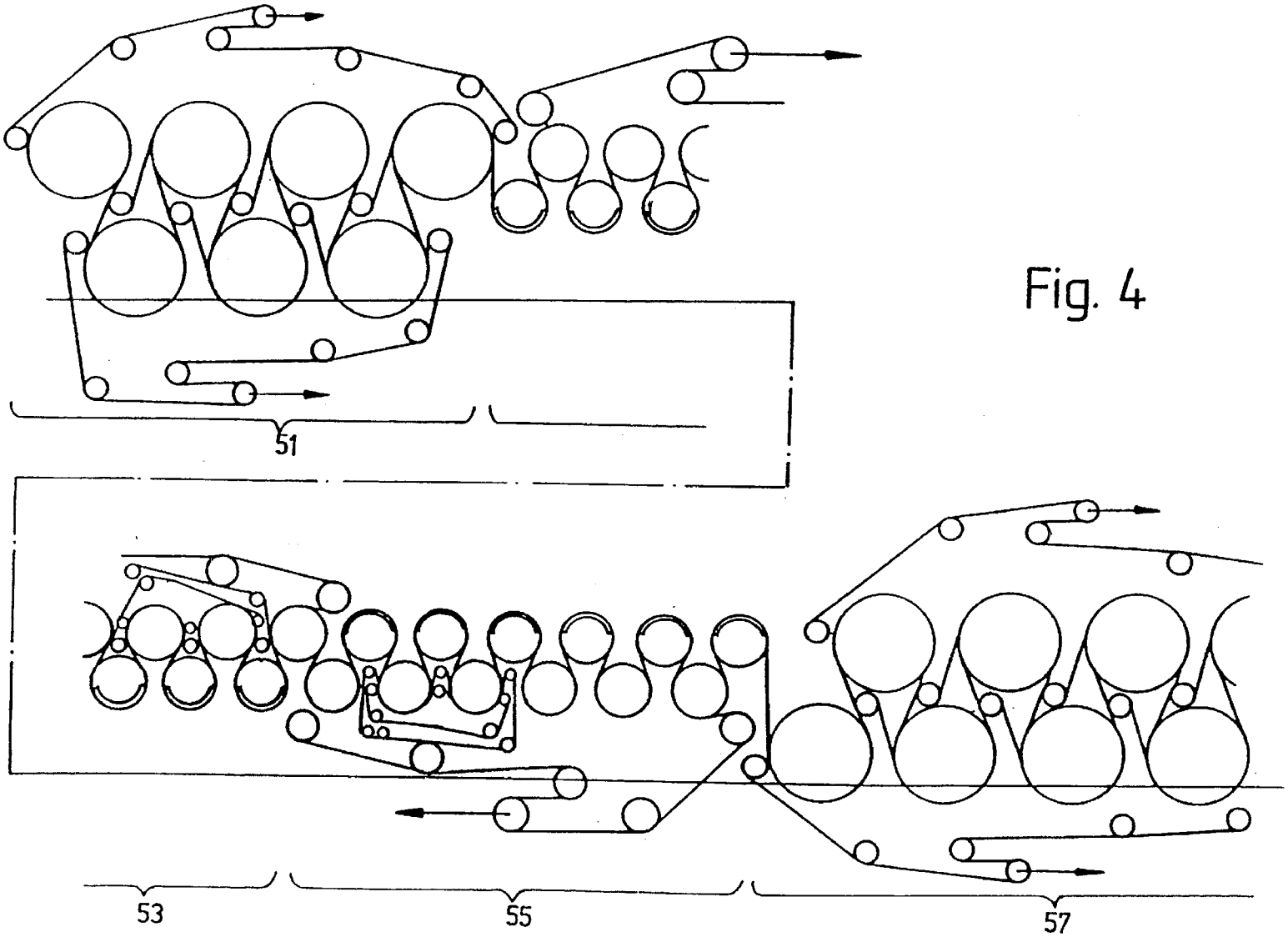
FIG. 4 shows a schematic view of a dry end including several drying units according to the present invention.

FIG. 4 shows a schematic view of a dry end formed of single-row and double-row dry units 51, 53, 55 and 56 following one another.

A paper web, delivered from a press end, first passes through the double-row dry unit 51 and is heated there. In the following single-row dry unit 53, the paper web is heated to a greater extent, and it is pressed onto a dry cylinder with a greater force by an increased dry felt stress to achieve a better heating and compression of the paper web. With this arrangement, only the two last dry cylinders of the dry unit 53 are provided with a plurality of dry felts, as contemplated by the present invention, whereas in the embodiment of FIG. 2, all of the dry cylinders are associated with a plurality of dry felts.

In the following single-row dry unit 55, with the dry cylinders being located in the lower row, an increased pressing force is applied to the paper web due to the use, as contemplated by the present invention, a plurality of dry felts with the first two dry cylinders in the front region of the dry unit 55. At the end of the dry end, the double-row dry unit is provided.

In the embodiment shown in FIG. 4, the dry cylinders of the dry units 53 and 55, which are associated with a plurality of dry felts, as contemplated by the present invention, are gas fired to achieve a temperature of about 300° C. at which a danger of paper web splinting would have been especially big if the plurality of dry felts according to the present invention had not been provided.

Figure 5:
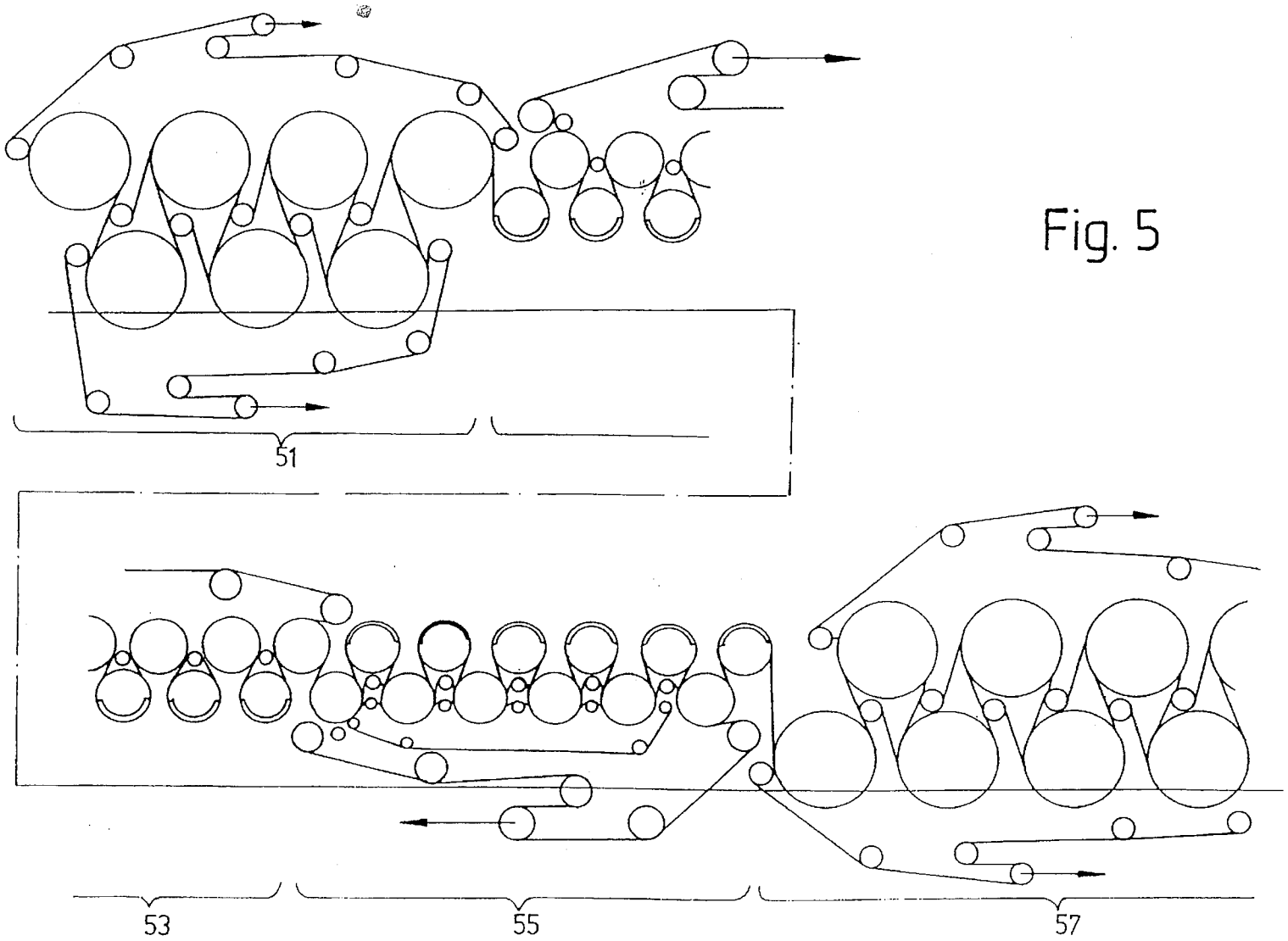
FIG. 5 shows a schematic view of a still further dry end including drying units according to the present invention.

FIG. 5 shows a schematic view of a dry end similar to that of FIG. 4 but with a difference which consists in that in the dry unit 53, two dry felts are associated with each drying cylinder, and in the dry unit 55, three dry felts are associated with each drying cylinder.

Obviously, more dry felts can be associated with a drying cylinder of a dry unit of a dry end. The use of a plurality of dry felts is not limited to single-row units of a dry end shown in FIGS. 4 and 5. The double-row dry unit drying cylinders likewise can be associated with a plurality of dry felts. At that, not only drying cylinders of one row can be associated with several dry felts, but the drying cylinders of both upper and lower rows can cooperate with a plurality of dry felts.

Though the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A dry unit of a dry end of a machine for producing a material web, said dry unit comprising:

at least two drying cylinders;

a plurality of dry felts passing around said at least two drying cylinders one above another, with the material web passing between an innermost of said plurality of dry felts and said drying cylinders;

means for lifting at least two of said plurality of dry felts of said at least two drying cylinders at different circumferential positions of said at least two of said plurality of dry felts on said at least two drying cylinders; and means for permitting a stepwise reduction of vapor pressure in said material web as said web passes between said innermost plurality of dry felts and said drying cylinder, by allowing said means for lifting said plurality of dryer felts at different circumferential positions.

2. A dry unit as set forth in claim 1, wherein the dry felts of said plurality of dry felts have different permeabilities decreasing, when viewed from inside and directed radially outwardly from said at least one drying cylinder, from inside out.

3. A dry unit as set forth in claim 1, wherein wrapping angles of separate dry felts of said plurality of dry felts decrease, when viewed from inside and directed radially outwardly from said at least one drying cylinder, from inside out.

4. A dry unit as set forth in claim 1, wherein an innermost of said plurality of dry felts has a smaller strength than a next dry felt adjacent thereto.

5. A dry unit as set forth in claim 1, wherein an innermost of said plurality of dry felts is one of formed of a finer material and formed of a thinner material than a next dry felt adjacent thereto.

6. A dry unit as set forth in claim 1, further comprising means for depositing the dry felts of said plurality of dry felts one above another one of simultaneously and one after another.

7. A dry unit as set forth in claim 1, wherein said plurality of dry felts comprises from two to four dry felts.

8. A dry unit as set forth in claim 1, wherein said dry unit is formed as a single-row dry unit consisting of a plurality of drying cylinders arranged in one row, and wherein said lifting means comprises a plurality of deflection rolls arranged in another row.

9. A dry unit as set forth in claim 8, wherein said deflection rolls are formed as dry suction rolls.

10. A dry unit as set forth in claim 9, wherein said dry suction rolls have a diameter substantially equal to a diameter of said dry cylinders.

* * * * *